US012151912B2

(12) United States Patent
Oda

(10) Patent No.: US 12,151,912 B2
(45) Date of Patent: Nov. 26, 2024

(54) RECORDING APPARATUS

(71) Applicant: SEIKO EPSON CORPORATION, Tokyo (JP)

(72) Inventor: Koji Oda, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 184 days.

(21) Appl. No.: 18/057,278

(22) Filed: Nov. 21, 2022

(65) Prior Publication Data

US 2023/0159293 A1 May 25, 2023

(30) Foreign Application Priority Data

Nov. 24, 2021 (JP) ..... 2021-189834

(51) Int. Cl.

| | |
|---|---|
| ***B65H 29/70*** | (2006.01) |
| ***B65H 29/12*** | (2006.01) |
| ***B65H 31/02*** | (2006.01) |
| ***B65H 31/22*** | (2006.01) |
| ***B65H 43/06*** | (2006.01) |

(52) U.S. Cl.

CPC ..... *B65H 29/70* (2013.01); *B65H 29/125* (2013.01); *B65H 31/02* (2013.01); *B65H 31/22* (2013.01); *B65H 43/06* (2013.01); *B65H 2301/4212* (2013.01); *B65H 2301/5122* (2013.01); *B65H 2402/10* (2013.01); *B65H 2511/15* (2013.01); *B65H 2801/06* (2013.01); *B65H 2801/27* (2013.01)

(58) Field of Classification Search

CPC ..... B65H 29/125; B65H 29/70; B65H 31/02; B65H 31/22; B65H 43/00; B65H 43/06; B65H 43/08; B65H 2301/4212; B65H 2301/51214; B65H 2301/5122; B65H 2402/10; B65H 2511/15; B65H 2553/412; B65H 2553/416; B65H 2801/06; B65H 2801/27

See application file for complete search history.

(56) References Cited

U.S. PATENT DOCUMENTS

| | | | | |
|---|---|---|---|---|
| 2016/0363907 | A1 | 12/2016 | Enomoto et al. | |
| 2017/0240376 | A1* | 8/2017 | Shirasaki | G03G 15/6541 |
| 2020/0122940 | A1* | 4/2020 | Isobe | B65H 29/14 |
| 2022/0382198 | A1* | 12/2022 | Sekimizu | G03G 15/6579 |

FOREIGN PATENT DOCUMENTS

JP 2017-001879 A 1/2017

* cited by examiner

*Primary Examiner* — Prasad V Gokhale

(74) *Attorney, Agent, or Firm* — WORKMAN NYDEGGER

(57) ABSTRACT

A recording apparatus includes a recording unit, a discharge unit that discharges a medium on which recording is performed by the recording unit, and a medium receiving unit that receives a medium discharged by the discharge unit, and a medium can be fed to an optional device attached to an apparatus main body from the discharge unit. The discharge unit includes a discharge roller that discharges a medium, a forming unit that forms a medium to be discharged, and a detection unit that detects a stacking height of a medium stacked on the medium receiving unit and is located at a position where the detection unit interferes with the optional device when the optional device is attached, the detection unit and the forming unit are integrally configured, and the detection unit and the forming unit are configured to be integrally attached to and removed from the apparatus main body.

8 Claims, 10 Drawing Sheets

RECORDING APPARATUS

The present application is based on, and claims priority from JP Application Serial Number 2021-189834, filed Nov. 24, 2021, the disclosure of which is hereby incorporated by reference herein in its entirety.

BACKGROUND

1. Technical Field

The present disclosure relates to a recording apparatus that performs recording on a medium.

2. Related Art

In a recording apparatus represented by a printer, in some cases, post-processing is performed on a medium on which recording has been performed. Examples of the post-processing include binding processing with binding needles. In addition, in some cases, a post-processing device that performs post-processing as described above is attached to the recording apparatus later as an optional device. The post-processing device is attached to a discharge unit that discharges a medium on which recording has been performed in the recording apparatus. However, in some cases, when the post-processing device is attached, the configuration of the recording apparatus needs to be changed. For example, JP-A-2017-1879 describes that in order to switch stiffening conditions for stiffening a medium before and after attachment of the post-processing device, a paper discharge roller is replaced.

When the post-processing device is attached, not only a change of the stiffening conditions, but also another operation may be required. In particular, a member provided in an attachment area of the post-processing device needs to be removed. However, a configuration in which a plurality of operations is separately performed requires a long operation time.

SUMMARY

The present disclosure is a recording apparatus including a recording unit that performs recording on a medium, a discharge unit that discharges a medium on which recording is performed by the recording unit, and a medium receiving unit that receives a medium discharged by the discharge unit, in which a medium is fed to an optional device attached to an apparatus main body from the discharge unit, the discharge unit includes a discharge roller that discharges a medium, a forming unit that forms a medium to be discharged, and a detection unit that detects a stacking height of a medium stacked on the medium receiving unit and is located at a position where the detection unit interferes with the optional device when the optional device is attached, the detection unit and the forming unit are integrally configured, and the detection unit and the forming unit are configured to be integrally attached to and removed from the apparatus main body.

In addition, the present disclosure is a recording apparatus including a recording unit that performs recording on a medium, a discharge unit that discharges a medium on which recording is performed by the recording unit, and a medium receiving unit that receives a medium discharged by the discharge unit, in which a medium is fed to an optional device attached to an apparatus main body from the discharge unit, the discharge unit includes a discharge roller that discharges a medium, and a forming unit that forms a medium to be discharged, at least a part of the medium receiving unit is an attaching and removing portion that is configured to be attached to and removed from the apparatus main body, the attaching and removing portion is located at a position where the attaching and removing portion interferes with the optional device when the optional device is attached, the detection unit and the forming unit are integrally configured, and the detection unit and the forming unit are configured to be integrally attached to and removed from the apparatus main body.

In addition, the present disclosure is a recording apparatus including a recording unit that performs recording on a medium, a discharge unit that discharges a medium on which recording is performed by the recording unit, and a medium receiving unit that receives a medium discharged by the discharge unit, in which a medium is fed to an optional device attached to an apparatus main body from the discharge unit, the discharge unit includes a discharge roller that discharges a medium, a forming unit that forms a medium to be discharged, and a detection unit that detects a stacking height of a medium stacked on the medium receiving unit, is located at a position where the detection unit interferes with the optional device when the optional device is attached, and is configured to be attached to and removed from the apparatus main body, the forming unit is configured to switch between a first state in which the forming unit forms a medium and a second state in which the forming unit is separated from the medium from the first state, the detection unit is provided and engaged with the forming unit, and when the detection unit is removed, the forming unit switches from the first state to the second state.

DESCRIPTION OF EXEMPLARY EMBODIMENTS

Figure 1:
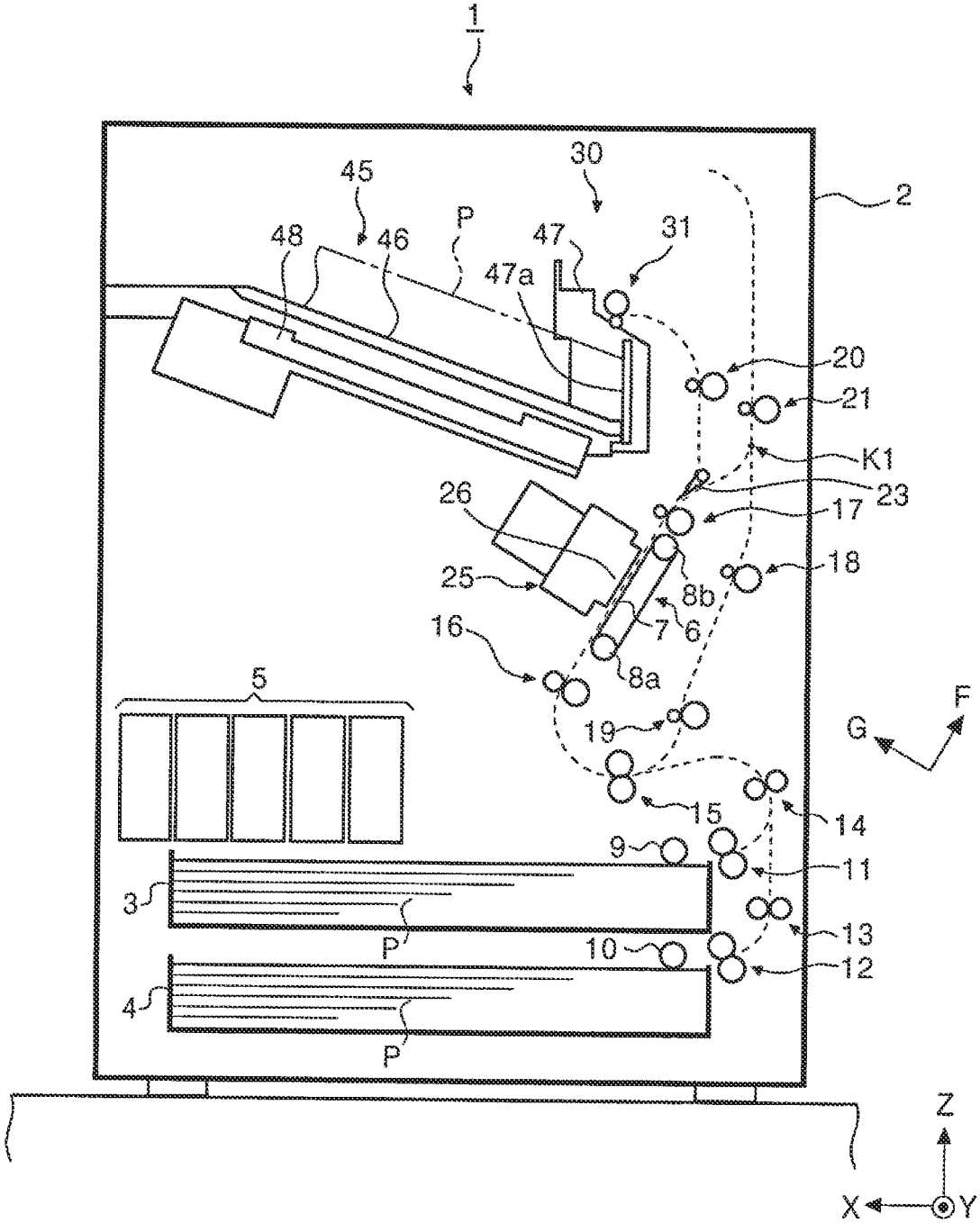
FIG. 1 is a view illustrating a medium transportation path of a printer in a state where a post-processing device is not attached.

Hereinafter, the present disclosure will be schematically described. According to the first aspect, a recording apparatus includes a recording unit that performs recording on a medium, a discharge unit that discharges a medium on which recording is performed by the recording unit, and a medium receiving unit that receives a medium discharged by the discharge unit, and a medium is fed to an optional device attached to an apparatus main body from the discharge unit, the discharge unit includes a discharge roller that discharges a medium, a forming unit that forms a medium to be discharged, and a detection unit that detects a stacking height of a medium stacked on the medium receiving unit and is located at a position where the detection unit interferes with the optional device when the optional device is attached, the detection unit and the forming unit are integrally configured, and the detection unit and the forming unit are configured to be integrally attached to and removed from the apparatus main body.

Since forming of a medium by the forming unit easily causes a transportation failure in the optional device when the optional device is attached, the forming unit needs to be prevented from functioning when the optional device is attached. In addition, since the detection unit is located at a position where the detection unit interferes with the optional device when the optional device is attached, the detection unit needs to be removed when the optional device is attached. In such a configuration, since the detection unit and the forming unit are integrally configured, when one of the detection unit and forming unit is removed, another one of the detection unit and forming unit is removed. Therefore, compared to a configuration in which the detection unit and the forming unit are separately removed, an operation time required for attaching the optional device can be reduced.

In addition, a relative positional relation between the detection unit and the forming unit in a medium stacking direction in the medium receiving unit is important. For example, when detection information of the detection unit is used to avoid a collision of a medium to be discharged with a medium stacked on the medium receiving unit, if positions of the detection unit and the forming unit in the medium stacking direction are closer to each other than expected, the medium to be discharged easily collides with the medium stacked on the medium receiving unit. However, since the detection unit and the forming unit are integrally configured, and the detection unit and the forming unit can be integrally attached to and removed from the apparatus main body, the relative positional relation between the detection unit and the forming unit is maintained, and the occurrence of the above-described problem can be suppressed.

According to the second aspect, in the first aspect, at least a part of the medium receiving unit is an attaching and removing portion that is configured to be attached to and removed from the apparatus main body, and the detection unit and the forming unit are integrally configured through the attaching and removing portion. According to this aspect, since the detection unit and the forming unit are integrally configured through the attaching and removing portion that configures the medium receiving unit, a dedicated member for integrally configuring the detection unit and the forming unit is unnecessary, and an increase in cost of the apparatus can be suppressed.

According to the third aspect, in the second aspect, the attaching and removing portion is located at a position where the attaching and removing portion interferes with the optional device when the optional device is attached. According to this aspect, since the attaching and removing portion is located at a position where the attaching and removing portion interferes with the optional device when the optional device is attached, in addition to the detection unit and the forming unit, the attaching and removing portion needs to be removed when the optional device is attached, but since the detection unit, the forming unit, and the attaching and removing portion are integrally configured, each of the detection unit, the forming unit, and the attaching and removing portion does not have to be separately removed, and an operation time required for attaching the optional device can be reduced.

According to the fourth aspect, in the third aspect, the attaching and removing portion abuts on a rear end of a medium stocked on the medium receiving unit and defines a position of the rear end. According to this aspect, in a configuration in which the attaching and removing portion abuts on a rear end of a medium stocked on the medium receiving unit defines a position of the rear end, the above-described effect of the third aspect can be obtained.

According to the fifth aspect, in any one of the first to the fourth aspects, the detection unit includes a light emitter that emits detection light in a width direction intersecting with a discharge direction of a medium, and a light receiver that receives the detection light, and the light emitter and the light receiver are provided at positions where the light emitter and the light receiver mutually face interposing, between the light emitter and the light receiver, a medium stacked on the medium receiving unit in the width direction.

According to this aspect, the light emitter and the light receiver are provided at positions where the light emitter and the light receiver mutually face interposing, between the light emitter and the light receiver, a medium stacked on the medium receiving unit in the width direction, and an installation space of the detection unit is required on each side of the medium receiving unit in the width direction, and thus the apparatus tends to increase in size. However, the detection unit, that is, the light emitter and the light receiver are located at positions where the light emitter and the light receiver interfere with the optional device when the optional device is attached, the optional device does not have to be designed so as to avoid the detection unit, and a further increase in size of the apparatus due to the attachment of the optional device can be suppressed.

According to the sixth aspect, in any one of the first to the fifth aspects, when the forming unit integrally configured with the detection unit is a first forming unit that comes into contact with a first surface of a medium, the discharge unit includes a second forming unit that comes into contact with a second surface opposite to the first surface of the medium and forms the medium together with the first forming unit, the first forming unit, of the first forming unit and the second forming unit, is integrally configured with the detection unit, and the first forming unit is located downstream in a discharge direction of a medium with respect to the second forming unit.

Since the first forming unit is located downstream in a discharge direction of a medium with respect to the second forming unit, the first forming unit more substantially affects, than the second forming unit does, the discharge position of the medium receiving unit in the medium stacking direction. In such a configuration, since the first forming unit is integrally configured with the detection unit, and the detection unit and the first forming unit can be integrally attached to and removed from the apparatus main body, the relative positional relation between the detection unit and the first forming unit can be maintained. As a result, the occurrence of the above-described problem, that is, the problem caused by displacement of the relative positional relation between the detection unit and the first forming unit can be suppressed.

According to the seventh aspect, a recording apparatus includes a recording unit that performs recording on a medium, a discharge unit that discharges a medium on which recording is performed by the recording unit, and a medium receiving unit that receives a medium discharged by the discharge unit, and a medium is fed to an optional device attached to an apparatus main body from the discharge unit, the discharge unit includes a discharge roller that discharges a medium, and a forming unit that forms a medium to be discharged, at least a part of the medium receiving unit is an attaching and removing portion that is configured to be attached to and removed from the apparatus main body, the attaching and removing portion is located at a position where the attaching and removing portion interferes with the optional device when the optional device is attached, and the attaching and removing portion and the forming unit are integrally configured and are configured to be integrally attached to and removed from the apparatus main body.

Forming of a medium by the forming unit easily causes a transportation failure in the optional device when the optional device is attached, and the forming unit needs to be prevented from functioning when the optional device is attached. In addition, since at least a part of the medium receiving unit is an attaching and removing portion that is configured to be attached to and removed from the apparatus main body, and the attaching and removing portion is located at a position where the attaching and removing portion interferes with the optional device when the optional device is attached, the attaching and removing portion needs to be removed when the optional device is attached. In such a configuration, since the attaching and removing portion and the forming unit are integrally configured, when one of the attaching and removing portion and the forming unit is removed, another one of the attaching and removing portion and the forming unit is removed. Therefore, compared to a configuration in which the attaching and removing portion and forming unit are separately removed, an operation time required for attaching the optional device can be reduced.

According to the eighth aspect, a recording apparatus includes a recording unit that performs recording on a medium, a discharge unit that discharges a medium on which recording is performed by the recording unit, and a medium receiving unit that receives a medium discharged by the discharge unit, and a medium is fed to an optional device attached to an apparatus main body from the discharge unit, the discharge unit includes a discharge roller that discharges a medium, a forming unit that forms a medium to be discharged, and a detection unit that detects a stacking height of a medium stacked on the medium receiving unit, is located at a position where the detection unit interferes with the optional device when the optional device is attached, and is configured to be attached to and removed from the apparatus main body, the forming unit is configured to switch between a first state in which the forming unit forms a medium and a second state in which the forming unit is separated from the medium from the first state, the detection unit is provided and engaged with the forming unit, and when the detection unit is removed, the forming unit switches from the first state to the second state.

Forming of a medium by the forming unit easily causes a transportation failure in the optional device when the optional device is attached, and the forming unit needs to be prevented from functioning when the optional device is attached. In addition, since the detection unit is located at a position where the detection unit interferes with the optional device when the optional device is attached, the detection unit needs to be removed when the optional device is attached. In such a configuration, since the detection unit is provided and engaged with the forming unit, and when the detection unit is removed, the forming unit switches from the first state to the second state. Therefore, compared to a configuration in which removal of the detection unit and switching of the state of the forming unit are separately performed, an operation time required for attaching the optional device can be reduced.

Hereinafter, the present disclosure is described in detail. In the following description, an ink jet printer 1 that performs recording by discharging a liquid represented by ink on a medium represented by recording paper is an example of the recording apparatus. Hereinafter, the ink jet printer 1 is abbreviated as printer 1.

The X-Y-Z coordinate system illustrated in each figure is an orthogonal coordinate system, and the Y-axis direction is a width direction intersecting with a transportation direction of a medium and is also an apparatus depth direction. The +Y direction, of the Y-axis direction, that is a direction in which the arrow directs is a direction from the apparatus back surface to the apparatus front surface, and the −Y direction opposite to the +Y direction is a direction from the apparatus front surface to the apparatus back surface. In addition, the X-axis direction is an apparatus width direction, the +X direction that is a direction in which the arrow directs when seen from the operator of the printer 1 is the left side, and the −X direction opposite thereto is the right side. The Z-axis direction is a vertical direction, that is, an apparatus height direction, the +Z direction that is a direction in which the arrow directs is upward, and the −Z direction opposite thereto is downward. Hereinafter, when the term "up" is used, the direction is the +Z direction, and when the term "down" is used, the direction is the −Z direction.

In addition, the G-axis direction is a normal direction with respect to an ink discharge surface of a line head 26 described later, the +G direction that is a direction in which the arrow directs is a direction in which a head unit 25 described later is separated from a transportation belt 7, and the −G direction opposite thereto is a direction in which the head unit 25 approaches the transportation belt 7. In addition, the F-axis direction is a direction parallel to the ink discharge surface of the line head 26 and a medium transportation direction at a location facing the line head 26, the +F direction that is a direction in which the arrow directs is downstream in the transportation direction, and the −F direction opposite thereto is upstream in the transportation direction. Note that in the following description, the direction in which a medium is fed may be referred to as downstream, and the direction opposite thereto may be referred to as upstream.

In FIG. 1, a medium transportation path is indicated with a broken line. In the printer 1, a medium is transported through medium transportation paths indicated with broken lines. An apparatus main body 2 of the printer 1 includes a first medium cassette 3 and a second medium cassette 4 that store media before being fed. A medium P is a medium stored in each medium cassette. The first medium cassette 3 and the second medium cassette 4 are provided so as to be attached to and removed from the apparatus main body 2 from the apparatus front side. A pick roller 9 that feeds a medium stored is provided for the first medium cassette 3, and a pick roller 10 that feeds a medium stored is provided for the second medium cassette 4.

In addition, a pair of feeding rollers 11 that feeds the medium fed obliquely upward is provided for the first medium cassette 3. In addition, a pair of feeding rollers 12 that feeds the medium fed obliquely upward and a pair of transportation rollers 13 that transports the medium upward are provided for the second cassette 4. Note that in the following description, unless otherwise noted, "a pair of rollers" is configured by a driving roller that is driven by a motor (not illustrated) and a driven roller that is driven and rotated while being in contact with the driving roller.

The medium fed from each medium cassette is fed by a pair of transportation rollers 14 and a pair of transportation rollers 15 to a pair of transportation rollers 16. The medium that receives a feeding power from the pair of transportation rollers 16 is fed to a position between the line head 26 and the transportation belt 7, that is, a position facing the line head 26.

The line head 26 is provided in the head unit 25 and performs recording by discharging ink on a surface of the medium. The line head 26 is an ink discharge head configured such that a nozzle (not illustrated) that discharges ink covers the entire area in the medium width direction and is configured as an ink discharge head that can perform recording on the entire area of the width of the medium without moving in the medium width direction. The line head 26 is an example of a recording unit that performs recording on a medium.

An ink storage portion 5 stores ink. Ink discharged from the line head 26 is supplied from the ink storage portion 5 to the line head 26 via a tube (not illustrated). The ink storage portion 5 is configured by a plurality of ink tanks disposed in the X-axis direction.

The transportation belt 7, and pulleys 8*a* and 8*b* constitute a transportation unit 6. The transportation belt 7 is an endless belt that is stretched between the pulley 8*a* and the pulley 8*b* disposed in the medium transportation direction. The transportation belt 7 is rotated as at least one of the pulley 8*a* and the pulley 8*b* is driven by a motor (not illustrated). The medium is transported at a position facing the line head 26 while being sucked onto a belt surface of the transportation belt 7. Suction of the medium onto the transportation belt 7 can adopt a known sucking system such as an air suction system and an electrostatic clinging system.

Here, the medium transportation path that passes through the position facing the line head 26 intersects with both of the horizontal direction and the vertical direction and transports the medium obliquely upward. The obliquely upward transportation direction is a direction including a −X direction component and a +Z direction component in FIG. 1, and with such a configuration, the dimension of the printer 1 in the horizontal direction can be restricted. Note that in the present embodiment, the inclination angle of the medium transportation path that passes through the position facing the line head 26 is set within a range from 50° to 70° with respect to the horizontal direction, and more specifically, is set to an inclination angle of 60°.

The medium on which recording has been performed on the first surface by the line head 26 is transported further obliquely upward by a pair of transportation rollers 17 located downstream of the transportation belt 7. A flap 23 is provided downstream of the pair of transportation rollers 17, and the flap 23 switches the transportation direction of the medium. When the medium is discharged as it is, the flap 23 switches the medium transportation path such that the medium is transported upward toward a pair of transportation rollers 20. A pair of discharge rollers 31 is further provided downstream of the pair of transportation rollers 20, and the medium is discharged to a medium receiving unit 45 or discharged to a post-processing device 100 (see FIG. 2) described later by the pair of discharge rollers 31. The pair of discharge rollers 31 constitutes a discharge unit 30. Note that in the present embodiment, the medium discharge direction is obliquely upward including a +X direction component and a +Z direction component.

When recording is performed on the second surface of the medium in addition to the first surface, the flap 23 switches the transportation direction to obliquely upward including a −X direction component and a +Z component, and the medium passes through a branching position K1 and is fed to a switch-back path above the branching position K1. A pair of transportation rollers 21 is provided in the switch-back path. The medium that has entered the switch-back path is transported upward by the pair of transportation rollers 21, and after the rear end of the medium passes through the branching position K1, the rotation direction of the pair of transportation rollers 21 is switched, as a result of which the medium is transported downward.

The medium that has been transported downward by the pair of transportation rollers 21 receives a feeding force from a pair of transportation rollers 18, a pair of transportation rollers 19, and the pair of transportation rollers 15, reaches the pair of transportation rollers 16, and is fed to the position facing the line head 26 again by the pair of transportation rollers 16. The medium is fed to the position facing the line head 26 again, and the second surface of the medium on the opposite side of the first surface on which recording has already been performed faces the line head 26. As a result, recording on the second surface of the medium can be performed by the line head 26. The medium on which recording has been performed on the second surface is discharged to the medium receiving unit 45 or discharged to the post-processing device 100 (see FIG. 2) by the pair of discharge rollers 31.

Figure 4:
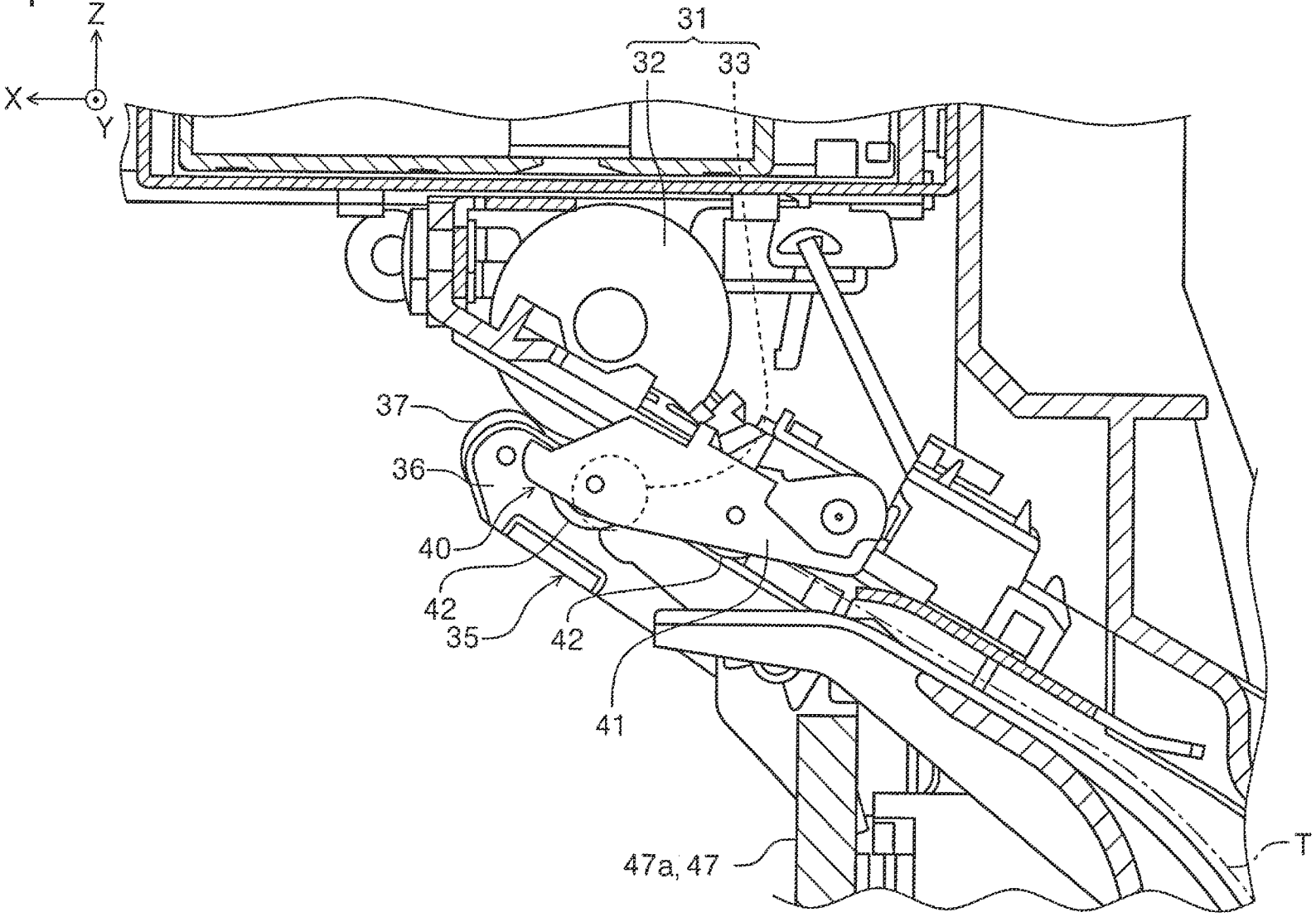
FIG. 4 is a side-sectional view of a part of the discharge unit.
Figure 5:
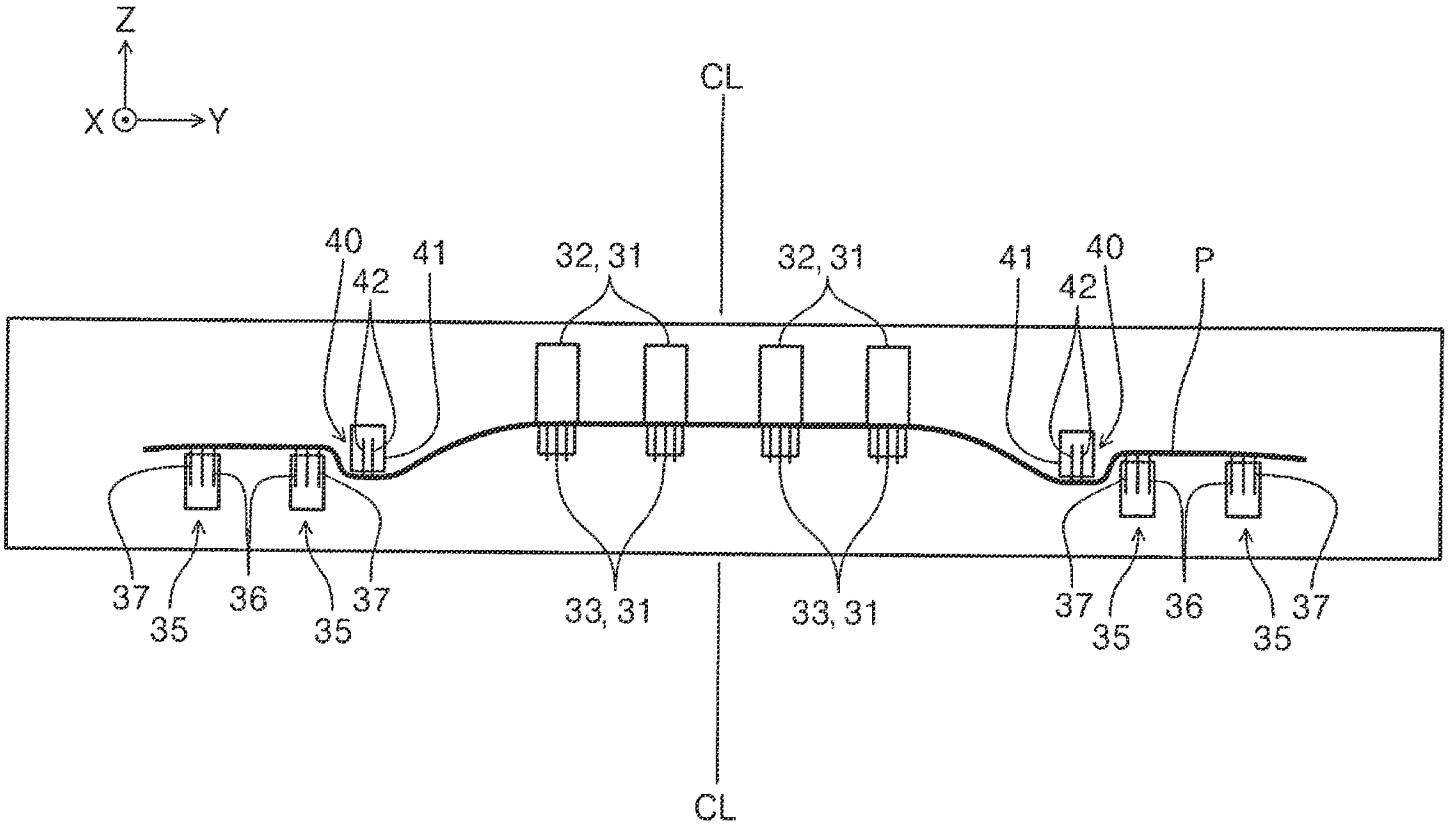
FIG. 5 is a front view of a part of the discharge unit.
Figure 6:
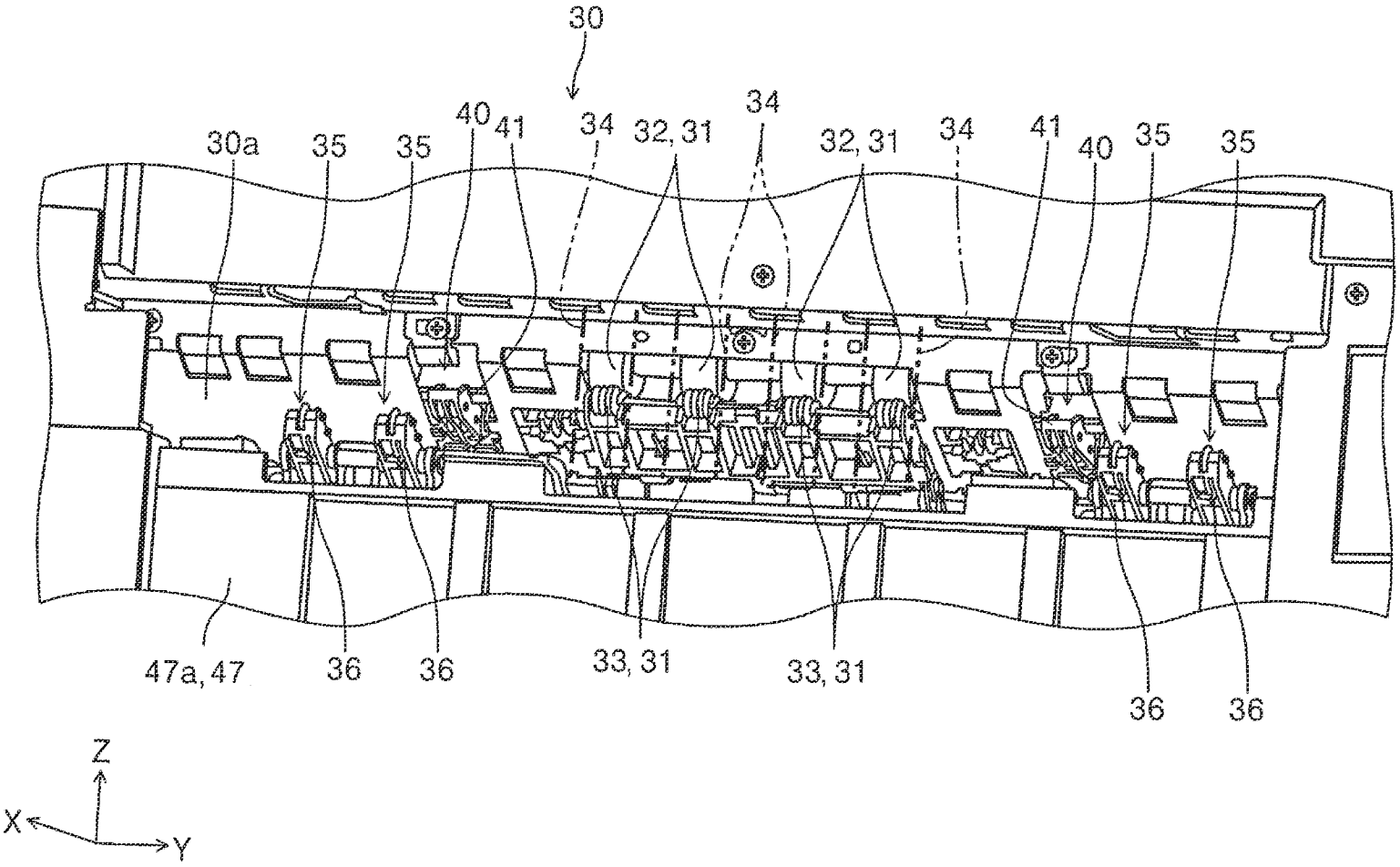
FIG. 6 is perspective view of a part of the discharge unit.

Subsequently, the discharge unit 30 and the medium receiving unit 45 will be further described. The discharge unit 30 includes a first forming unit 35 and a second forming unit 40 as illustrated in FIGS. 4 to 6, in addition to the above-described pair of discharge rollers 31. The pair of discharge rollers 31 includes a discharge driving roller 32 that comes into contact with the upper surface of the medium and a discharge driven roller 33 that comes into contact with the lower surface of the medium. In FIG. 5, the medium P represents a medium to be discharged. In the present embodiment, the discharge driving roller 32 is a rubber roller, and the discharge driven roller 33 is a spur. Two pairs of the discharge rollers 31 are provided on the left and right sides with respect to a central position CL (see FIG. 5) in the medium width direction and are also disposed at positions line-symmetrical with the central position CL.

The first forming unit 35 includes a first holder 36. The first holder 36 is provided with two driven rollers 37 in the medium transportation direction. Each driven roller 37 comes into contact with the lower surface of the medium to be discharged. Two first forming units 35 are provided on the left and right sides with respect to the central position CL (see FIG. 5) in the medium width direction and are also disposed at positions line-symmetrical with the central position CL.

The second forming unit 40 includes a second holder 41. The second holder 41 is provided with two driven rollers 42 in the medium discharge direction. Each driven roller 42 comes into contact with the upper surface of the medium to be discharged. One second forming unit 40 is provided on the left and right sides with respect to the central position CL (see FIG. 5) in the medium width direction and is also disposed at positions line-symmetrical with the central position CL.

As illustrated in FIGS. 4 and 5, each first forming unit 35 and each second forming unit 40 are provided so as to overlap with each other in the Z-axis direction, as a result of which the medium to be discharged is formed so as to form a waved shape in the medium width direction as illustrated in FIG. 5. By the forming described above, the rigidity of the medium in the medium width direction is enhanced, and curling of the medium on the medium receiving unit 45, that is, curling in the medium discharge direction is suppressed.

Figure 3:
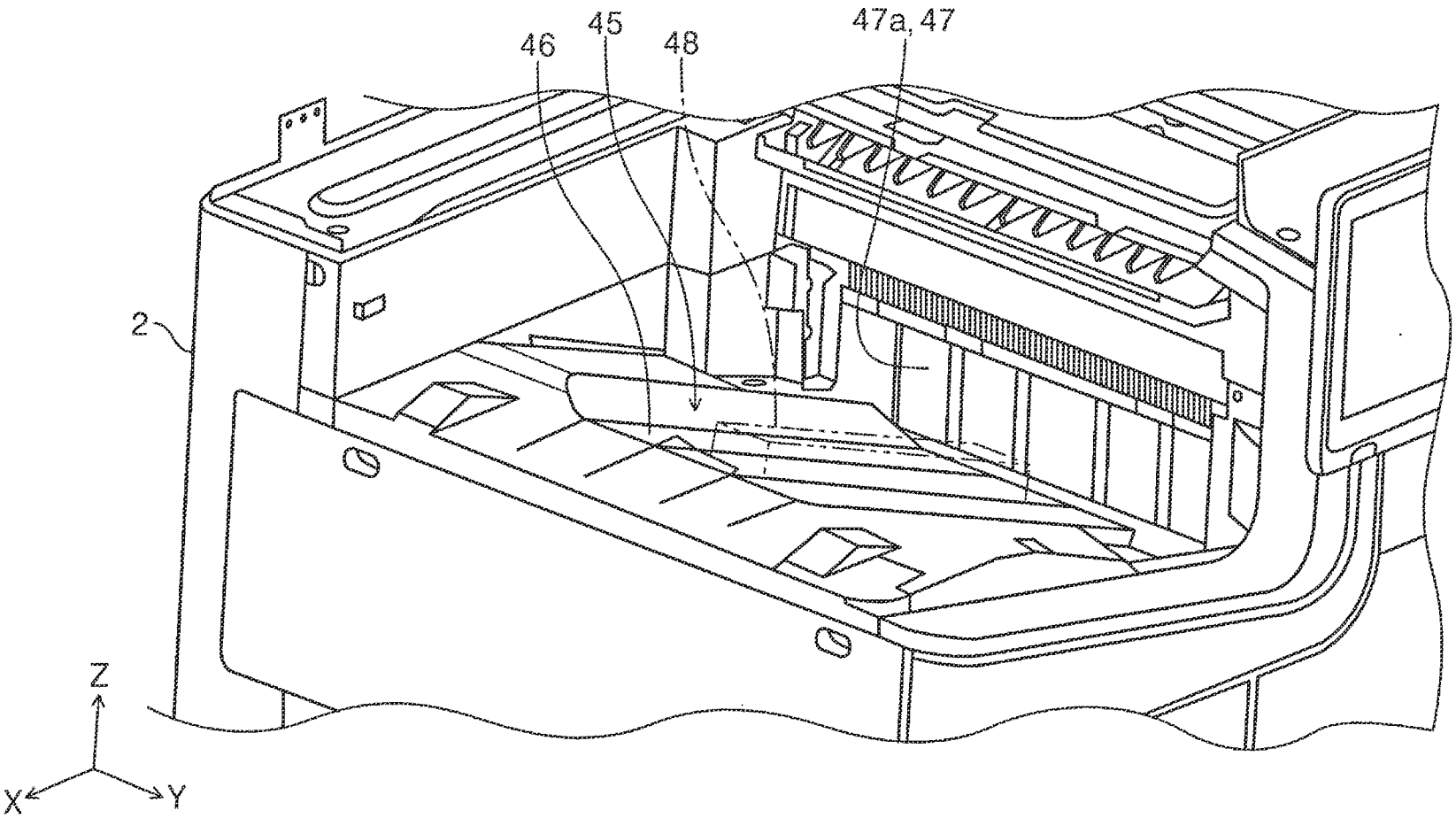
FIG. 3 is a perspective view illustrating an entire discharge unit.

Next, as illustrated in FIG. 3, the medium receiving unit 45 includes a tray 46, a rear end regulating member 47, and a displacement member 48. The tray 46 is provided so as to extend obliquely upward in the +X direction. The rear end regulating member 47 includes a regulating wall 47*a* that forms a wall surface along the Y-Z plane, and the regulating wall 47*a* comes into contact with the rear end of the medium stacked on the tray 46 to regulate the rear end position. The displacement member 48 is provided in a central portion of the tray 46 in the medium width direction and is provided so as to be able to switch between a state of projecting from the tray 46 and a state of not projecting by a driving mechanism (not illustrated). In the state in which the displacement member 48 projects from the tray 46, a medium to be stacked is bent so as to project upward in the medium width direction. As a result, the rigidity of the medium in the medium discharge direction is enhanced, and curling of the medium on the tray 46 in the medium discharge direction is suppressed.

Figure 7:
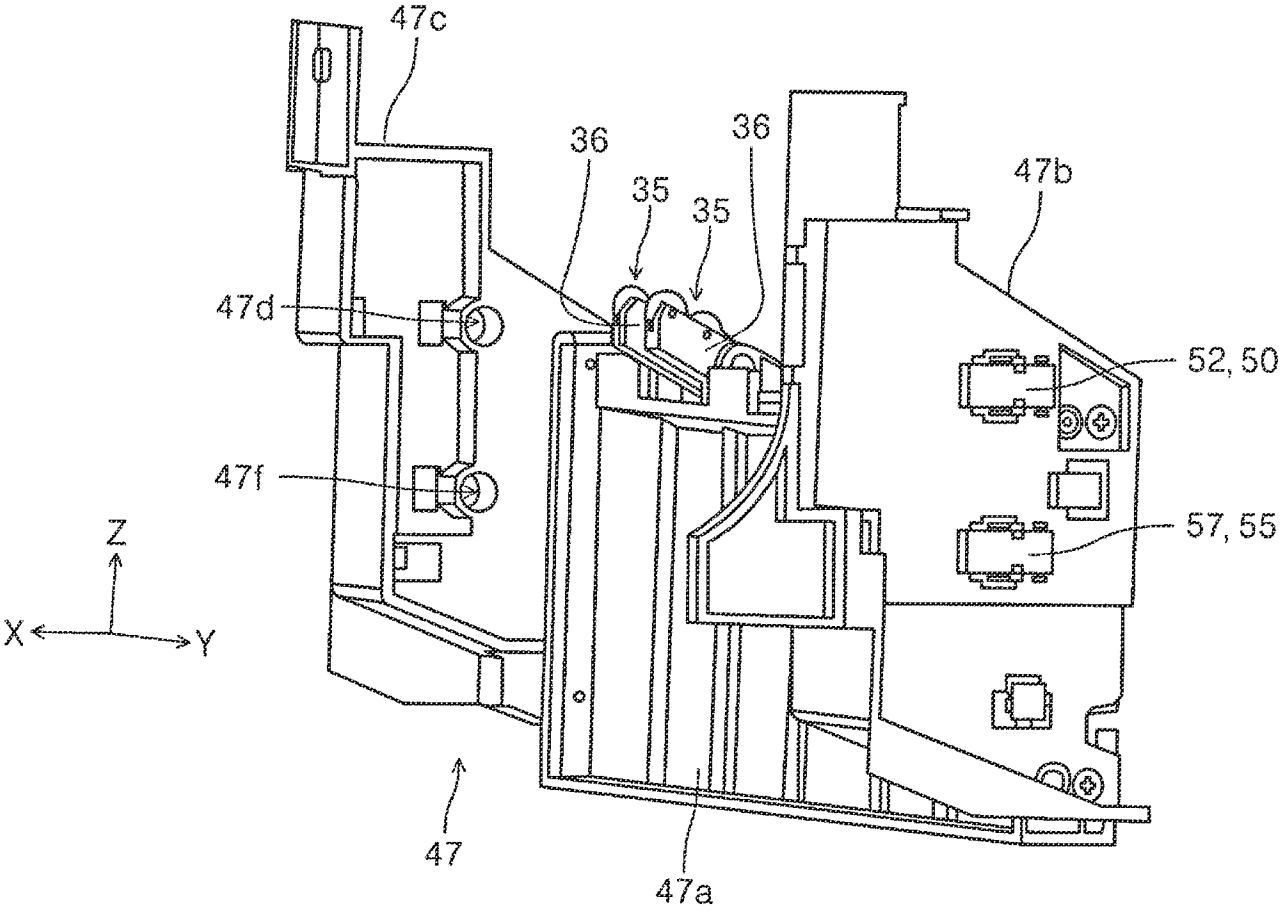
FIG. 7 is a perspective view of a rear end regulating member, which is an example of an attaching and removing portion.
Figure 8:
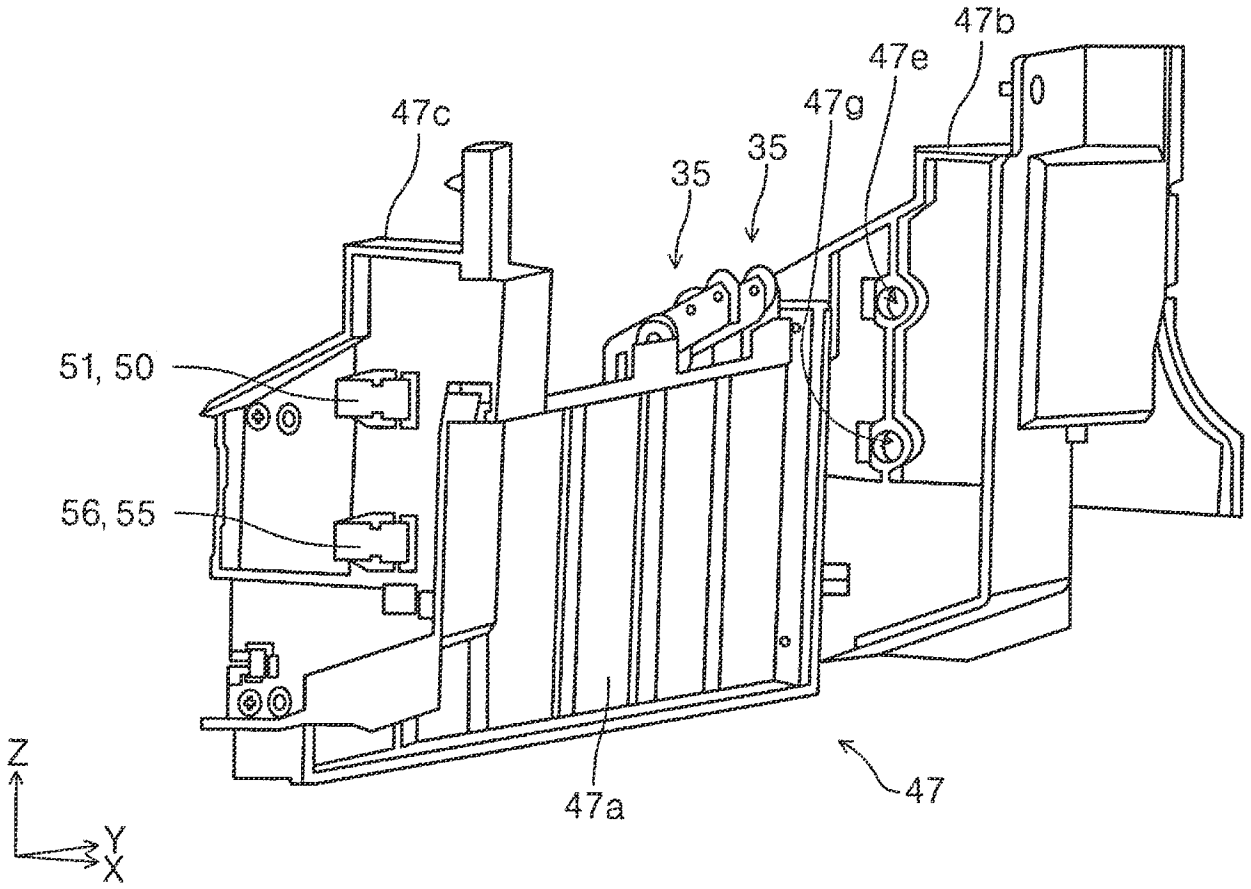
FIG. 8 is a perspective view of the rear end regulating member, which is an example of the attaching and removing portion.

As illustrated in FIGS. 7 and 8, the rear end regulating member 47 includes a first side wall 47*b* that forms a wall surface along the X-Z plane in an end portion in the +Y direction. In addition, the rear end regulating member 47 includes a second side wall 47*c* that forms a wall surface along the X-Z plane in an end portion in the −Y direction. On the first side wall 47*b*, a hole 47*e* is formed, and a hole 47*g* is formed below the hole 47*e*. At a position corresponding to the hole 47*e*, on a wall surface in the +Y direction, a first light receiver 52 constituting a first detection unit 50 is provided. In addition, at a position corresponding to the hole 47*g*, on the wall surface in the +Y direction, a second light receiver 57 constituting a second detection unit 55 is provided.

On the second side wall 47*c*, a hole 47*d* is formed, and a hole 47*f* is formed below the hole 47*d*. At a position corresponding to the hole 47*d*, on a wall surface in the −Y direction, a first light emitter 51 constituting the first detection unit 50 is provided. In addition, at a position corresponding to the hole 47*f*, on the wall surface in the −Y direction, a second light emitter 56 constituting the second detection unit 55 is provided.

The first light emitter 51 and the first light receiver 52 constituting the first detection unit 50 are disposed so as to mutually face interposing the medium stacked in the Y-axis direction therebetween and is configured such that detection light emitted from the first light emitter 51 reaches the first light receiver 52 through the holes 47*d* and 47*e*. Similarly, the second light emitter 56 and the second light receiver 57 constituting the second detection unit 55 are disposed so as to mutually face interposing the medium stacked in the Y-axis direction therebetween and is configured such that detection light emitted from the second light emitter 56 reaches the second light receiver 57 through the holes 47*f* and 47*g*.

According to the above-described configuration, a controller (not illustrated) of the printer 1 can detect that the medium stacking height on the tray 46 reaches a prescribed value based on a detection signal transmitted from the second detection unit 55 and can further detect that the medium stacking height on the tray 46 reaches the upper limit value based on a detection signal transmitted from the first detection unit 50. Note that the first detection unit 50 and the second detection unit 55 according to the present embodiment are examples of a detection unit for detecting the medium stacking height in the medium receiving unit 45. In other words, the first detection unit 50 and the second detection unit 55 are examples of a detection unit that detects that the medium stacking height in the medium receiving unit 45 reaches a prescribed height. However, the detection unit for detecting the medium stacking height in the medium receiving unit 45 is not limited thereto, and a configuration that can detect the medium stacking height in finer resolution may be adopted. Alternatively, on the contrary, a configuration in which the second detection unit 55 is omitted, and only the first detection unit 50 is provided so as to be able to detect the medium stacking height reaching the upper limit value only may be adopted.

The rear end regulating member 47 is provided with the first detection unit 50 and the second detection unit 55 described above, and the rear end regulating member 47 is further provided with the first forming unit 35, of the first forming unit 35 and the second forming unit 40 described above. The second forming unit 40 is provided in a frame 30*a* (see FIG. 6) constituting the apparatus main body 2.

Figure 2:
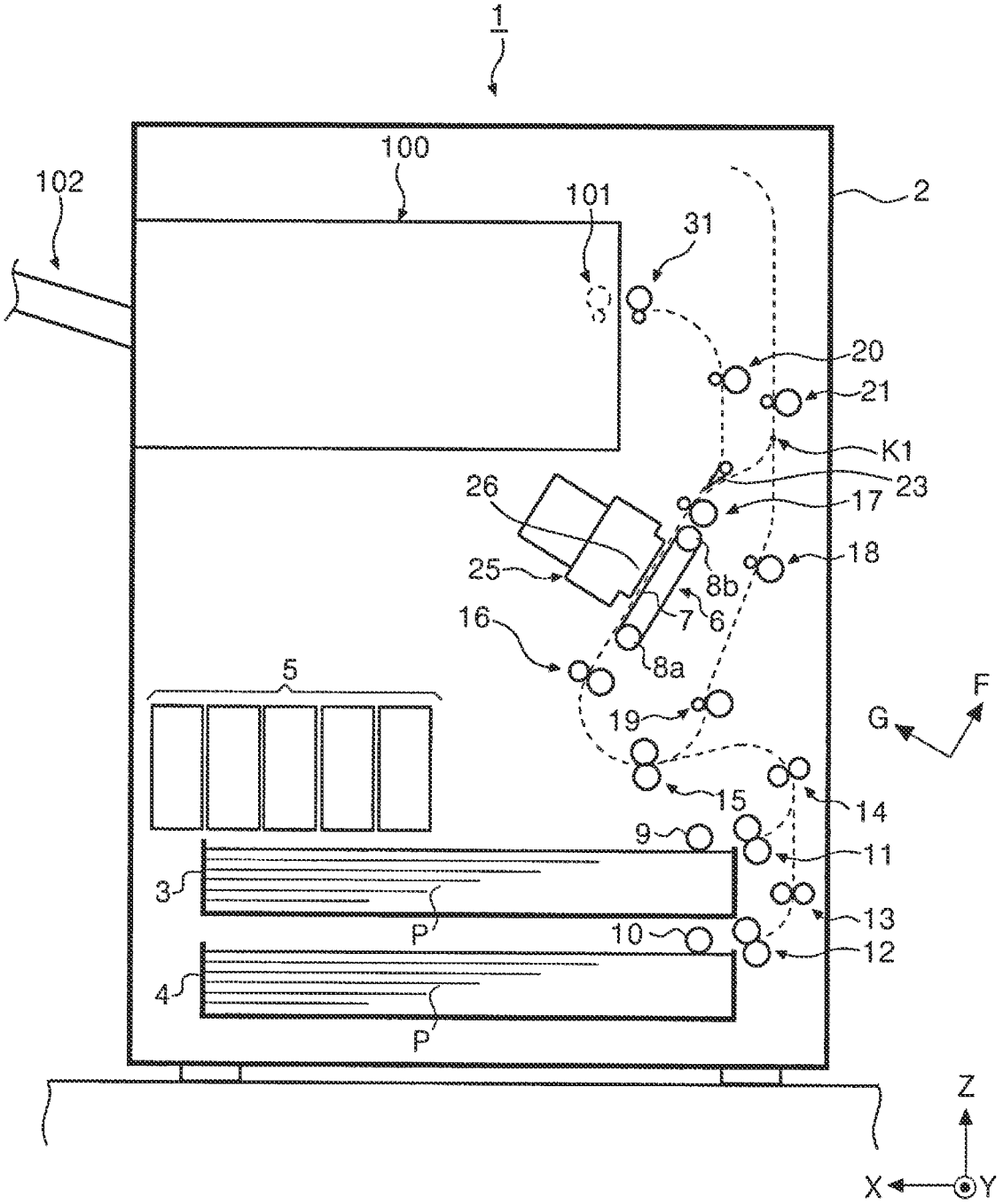
FIG. 2 is a view illustrating the medium transportation path of the printer in a state where the post-processing device is attached.

The tray 46 and the rear end regulating member 47 constituting the medium receiving unit 45 are separately configured, and each of the tray 46 and the rear end regulating member 47 is configured to be attached to and removed from the apparatus main body 2. The tray 46, the displacement member 48, and a driving mechanism (not illustrated) that displaces the displacement member 48 are integrally configured. When the tray 46, the displacement member 48, and the driving mechanism are removed from the state in FIG. 1 and then the rear end regulating member 47 is removed, the medium receiving unit 45 is removed from the apparatus main body 2. Then, as illustrated in FIG. 2, the post-processing device 100 that is an example of the optional device can be installed in a space formed by removing the medium receiving unit 45 from the apparatus main body 2. Then, the medium can be fed to the post-processing device 100 from the pair of discharge rollers 31. Note that although in the present embodiment, the post-processing device 100 that is an example of the optional device is configured to be installed in a space formed by removing the medium receiving unit 45 from the apparatus main body 2, the installation place of the optional device is not limited thereto, and for example, the optional device may be installed in an upper surface portion or a side surface portion of the printer 1 (the apparatus main body 2). For example, as an example of the configuration in which the optional device is disposed in a side surface portion, a configuration in which an intermediate device including a bridge path that receives a medium discharged from the apparatus main body 2 and transports the medium to the optional device is provided, the intermediate device includes the discharge unit and the medium receiving unit, and the optional device can be installed in a space formed by removing the medium receiving unit of the intermediate device may be adopted as a recording system. As another configuration example, a configuration in which the optional device is installed in the same manner as the configuration exemplified above as a recording system including three or more devices of the printer 1, the intermediate device, the optional device may be adopted. Any of recording systems configured by including a plurality of the exemplified devices is a recording apparatus of the present disclosure. By configurating the recording apparatus by the exemplified recording systems, recording by the printer 1 and processing by the optional device can be simultaneously performed, and thus the processing function can be expanded without inhibiting functions of the recording apparatus.

The post-processing device 100 includes a pair of introduction rollers 101, and the medium discharged from the pair of discharge rollers 31 is introduced into the post-processing device 100 by the pair of introduction rollers 101. The specific configuration of the inside of the post-processing device 100 is not illustrated and the description thereof will be omitted. However, in the present embodiment, the post-processing device 100 includes a processing tray (not illustrated) and a binding unit (not illustrated) in which binding processing is performed on the medium placed on the processing tray with binding needles. Then, the bound medium is discharged to a post-processing tray 102. Note that in the present embodiment, the post-processing device 100 performs binding processing, which is an example of the post-processing, on the medium, but the post-processing is not limited thereto. For example, punching processing may be performed on the medium, or center folding processing may be performed.

Figure 9:
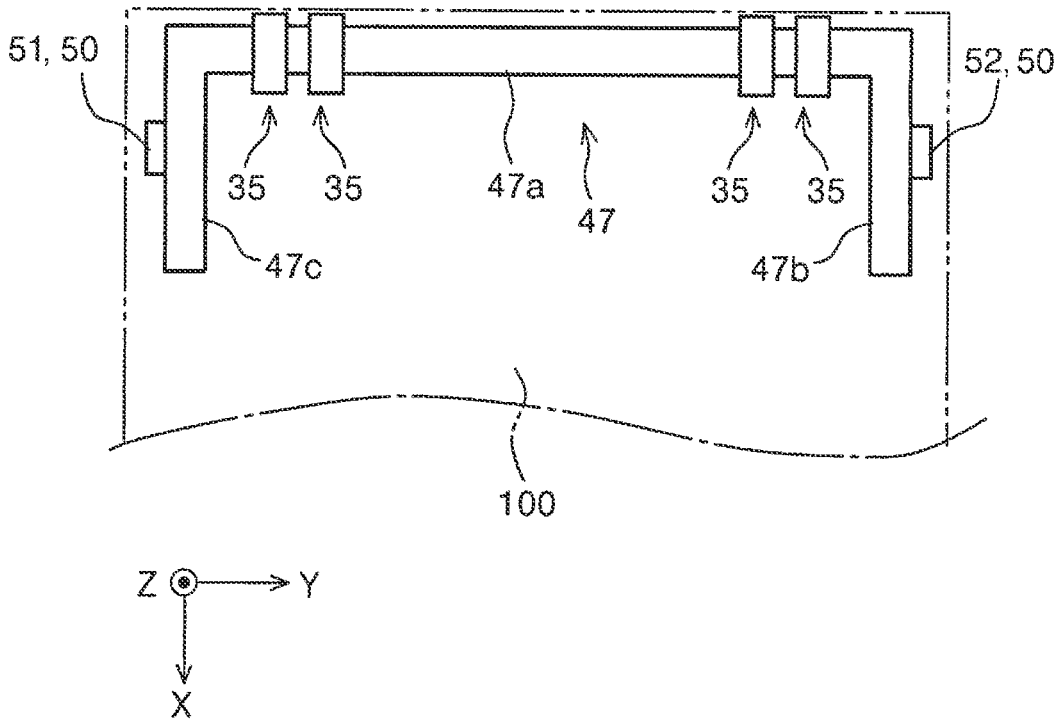
FIG. 9 is a plan view schematically illustrating the discharge unit.

As illustrated in FIG. 9, arranging areas of the rear end regulating member 47, the first forming unit 35, the first detection unit 50, and the second detection unit 55 overlap with the installation area of the post-processing device 100, and the post-processing device 100, and the rear end regulating member 47, the first forming unit 35, the first detection unit 50, and the second detection unit 55 are in such a positional relation that, in order to install the post-processing device 100, the rear end regulating member 47, the first forming unit 35, the first detection unit 50, and the second detection unit 55 need to be removed. Note that hereinafter, the first detection unit 50 and the second detection unit 55 may be collectively referred to as "detection units 50 and 55".

In addition, in the printer 1, the first forming unit 35 that forms the medium to be discharged and the detection units 50 and 55 that detect the stacking height of the medium stacked on the medium receiving unit 45 and are located at positions where the detection units 50 and 55 interfere with the post-processing device 100 when the post-processing device 100 is attached are integrally configured through the rear end regulating member 47. In addition, the detection units 50 and 55 and the first forming unit 35 can be attached to and removed from the apparatus main body 2.

As a result, the following effect is obtained. Forming of a medium by the first forming unit 35 easily causes a transportation failure in the post-processing device 100 when the post-processing device 100 is attached, and when the post-processing device 100 is attached, the first forming unit 35 needs to be prevented from functioning. In addition, since the detection units 50 and 55 are located at positions where the detection units 50 and 55 interfere with the post-processing device 100 when the post-processing device 100 is attached, the detection units 50 and 55 need to be removed when the post-processing device 100 is attached. In such a configuration, since the detection units 50 and 55 and the first forming unit 35 are integrally configured, compared to a configuration in which the detection units 50 and 55 and the first forming unit 35 are separately removed, an operation time required for attaching the post-processing device 100 can be reduced.

In addition, the relative positional relation between the first detection unit 50 and the first forming unit 35 in the medium receiving unit 45 in the medium stacking direction in the medium receiving unit 45 is important. For example, when detection information of the first detection unit 50 is used for avoiding a collision of a medium to be discharged with a medium stacked on the medium receiving unit 45, if the positions of the first detection unit 50 and the first forming unit 35 in the medium stacking direction are closer to each other than expected, the medium to be discharged easily collides with the medium stacked on the medium receiving unit 45. However, since the first detection unit 50 and the first forming unit 35 are integrally configured, and the first detection unit 50 and the first forming unit 35 can be integrally attached to and removed from the apparatus main body 2, the relative positional relation between the first detection unit 50 and the first forming unit 35 is maintained, and the occurrence of the above-described problem can be suppressed.

Note that in the present embodiment, a first connector (not illustrated) provided in cables (not illustrated) extending from the detection units 50 and 55 is fitted to a second connector (not illustrated) provided in the apparatus main body 2. Therefore, when the rear end regulating member 47, the detection units 50 and 55, and the first forming unit 35 are integrally removed from the apparatus main body 2, the user has to remove the first connector from the second connector. However, when the rear end regulating member 47, the detection units 50 and 55, and the first forming unit 35 are removed from the apparatus main body 2, the first connector may be configured to be removed from the second connector without depending on the operation by the user. In this case, when the rear end regulating member 47, the detection units 50 and 55, and the first forming unit 35 are attached to the apparatus main body 2, the first connector may be configured to be attached to the second connector without depending on the operation by the user.

In addition, in the printer 1, the rear end regulating member 47 that is at least a part of the medium receiving unit 45 is an attaching and removing portion that can be attached to and removed from the apparatus main body 2, and the rear end regulating member 47 is located at a position where the rear end regulating member 47 interferes with the post-processing device 100 when the post-processing device 100 is attached. In addition, the rear end regulating member 47 and the first forming unit 35 are integrally formed, and the rear end regulating member 47 and the first forming unit 35 can be integrally attached to and removed from the apparatus main body 2. Therefore, by removing the rear end regulating member 47, the first forming unit 35 is also removed, and compared to a configuration in which the rear end regulating member 47 and the first forming unit 35 are separately removed, an operation time required for attaching the post-processing device 100 can be reduced.

In addition, in the present embodiment, the detection units 50 and 55 and the first forming unit 35 are integrally configured through the rear end regulating member 47, a dedicated member for integrally configuring the detection units 50 and 55 and the first forming unit 35 is unnecessary, and an increase in cost of the apparatus can be suppressed.

In addition, the first light emitter 51 and the first light receiver 52 constituting the first detection unit 50 are disposed so as to mutually face interposing the medium stacked in the Y-axis direction, that is, the medium width direction therebetween. Similarly, the second light emitter 56 and the second light receiver 57 constituting the second detection unit 55 are disposed so as to mutually face interposing the medium stacked in the Y-axis direction, that is, the medium width direction therebetween. Therefore, an installation space of the first detection unit 50 and the second detection unit 55 is required on each side of the medium receiving unit 45, and thus the apparatus tends to increase in size. However, since the first detection unit 50 and the second detection unit 55 are located at positions where the first detection unit 50 and the second detection unit 55 interfere with the post-processing device 100 when the post-processing device 100 is attached, the post-processing device 100 does not have to be designed so as to avoid the first detection unit 50 and the second detection unit 55, and a further increase in size of the apparatus due to the installation of the post-processing device 100 can be suppressed.

In addition, the discharge unit 30 includes the first forming unit 35 and the second forming unit 40 that forms the medium together with the first forming unit 35, the first forming unit 35, of the first forming unit 35 and the second forming unit 40, is integrally configured with the detection units 50 and 55, and the first forming unit 35 is located downstream in the medium discharge direction with respect to the second forming unit 40. As a result, the following effect is obtained. Since the first forming unit 35 is located downstream in the medium discharge direction with respect to the second forming unit 40, the first forming unit 35 more substantially affects, than the second forming unit 40 does, the discharge position in the medium stacking direction. In such a configuration, since the first forming unit 35 is integrally configured with the first detection unit 50, and the first forming unit 35 and the first detection unit 50 can be integrally attached to and removed from the apparatus main body 2, the relative positional relation between the first detection unit 50 and the first forming unit 35 can be maintained. As a result, the occurrence of a problem caused by displacement of the relative positional relation between the first detection unit 50 and the first forming unit 35 can be suppressed. The problem caused by displacement of the relative positional relation between the first detection unit 50 and the first forming unit 35 results from, for example, the positions of the first detection unit 50 and the first forming unit 35 in the medium stacking direction being closer to each other than expected, and the medium to be discharged easily collides with the medium that is stacked.

Figure 10A:
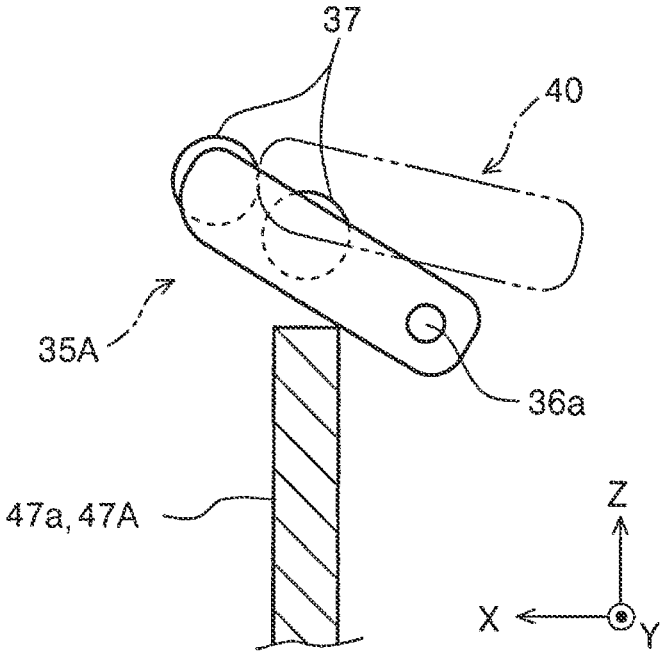
FIGS. 10A and 10B are side-sectional views of a part of a discharge unit according to another embodiment.

Subsequently, with reference to FIG. 10, a first forming unit 35A and a rear end regulating member 47A according to another embodiment will be described. Note that the embodiment described below is the same embodiment regarding configurations except for the configurations that are particularly described. The first forming unit 35A is provided so as to be rotatable around a rotation shaft 36*a* that is parallel to the Y-axis direction. As illustrated in FIG. 10A, in a state where the rear end regulating member 47A is attached to the apparatus main body 2, the first forming unit 35A is supported by the regulating wall 47*a*, and the first forming unit 35A is in a first state of forming a medium. Note that the first forming unit 35A according to the present embodiment is not integrally configured with the rear end regulating member 47A.

Figure 10B:
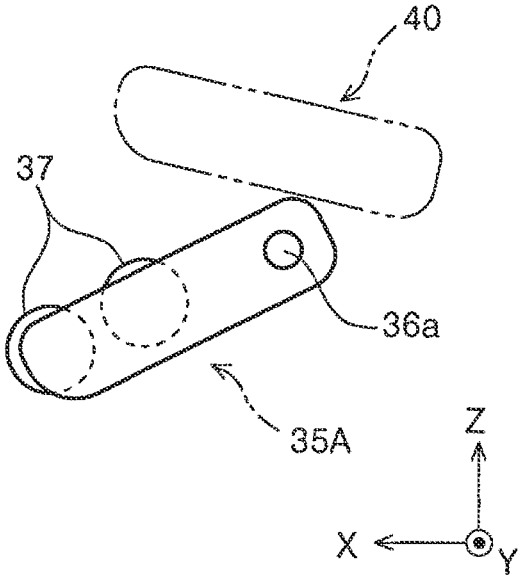

When the rear end regulating member 47A is removed from this state, as illustrated in FIG. 10B, supporting of the first forming unit 35A by the rear end regulating member 47A is released, the first forming unit 35A rotates downward and enters a second state of not forming the medium. Note that the downward rotation of the first forming unit 35A is stopped in the posture illustrated in FIG. 10B by a regulating member (not illustrated).

In this manner, the first forming unit 35A can switch between the first state (FIG. 10A) when forming a medium and the second state (FIG. 10B) in which the first forming unit 35A is separated from the first state. The detection units 50 and 55 are provided so as to be engaged with the first forming unit 35A through the rear end regulating member 47A, and when the rear end regulating member 47A, that is, the detection units 50 and 55 are removed, the first forming unit 35A switches from the first state to the second state. As a result, compared to a configuration in which removal of the detection units 50 and 55 and switching of the state of the first forming unit 35A are separately performed, an operation time required for attaching the post-processing device 100 can be reduced.

The above-described embodiments can be changed as follows. 1. In the first embodiment described with reference to FIGS. 1 to 9, the first forming unit 35 and the detection units 50 and 55 are integrally configured through the rear end regulating member 47, but a configuration in which the first forming unit 35 is integrally configured with the rear end regulating member 47, and when the rear end regulating member 47 is removed, the detection units 50 and 55 remain in the apparatus main body 2 may be adopted. In this case, a configuration in which when the rear end regulating member 47 is removed, the detection units 50 and 55 retreat from positions where the detection units 50 and 55 interfere with the post-processing device 100 may be adopted. In addition, in this case, it is preferred that when the removed rear end regulating member 47 is attached again, the detection units 50 and 55 are configured to return to their original positions from the retreating positions.

2. In the first embodiment described with reference to FIGS. 1 to 9, or in the second embodiment described with reference to FIG. 10, the second forming unit 40 may be configured to switch between the first state of forming a medium and the second state of not forming a medium. In this case, in the configuration described with reference to FIGS. 1 to 9, a configuration in which when the rear end regulating member 47 is removed from the apparatus main body 2, the first forming unit 35 and the detection units 50 and 55 are removed, and the second forming unit 40 also switches from the first state to the second state may be adopted. Note that in this case, it is preferred that when the rear end regulating member 47 is attached to the apparatus main body 2, the second forming unit 40 returns from the second state to the first state. In addition, in the configuration described with reference to FIG. 10, a configuration in which when the rear end regulating member 47A is removed from the apparatus main body 2, the first forming unit 35A switches between the first state of forming a medium and the second state of not forming a medium, and in addition to that, the second forming unit 40 switches from the first state to the second state may be adopted. Note that in this case, it is preferred that when the rear end regulating member 47A is attached to the apparatus main body 2, the second forming unit 40 is configured to return from the second state to the first state.

3. In the first embodiment described with reference to FIGS. 1 to 9, the rear end regulating member 47 and the first forming unit 35 are integrally configured, and when the rear end regulating member 47 and the first forming unit 35 are removed from the apparatus main body 2, the second forming unit 40 remains in the apparatus main body 2, but the rear end regulating member 47, the first forming unit 35, and the second forming unit 40 may be integrally configured. As a result, when the rear end regulating member 47 is removed, the first forming unit 35, the second forming unit 40, and the detection units 50 and 55 can be integrally removed. Alternatively, a configuration in which the rear end regulating member 47 and the second forming unit 40 are integrally configured, when the rear end regulating member 47 and the second forming unit 40 are removed, the first forming unit 35 remains in the apparatus main body 2 may be adopted.

4. In the second embodiment described with reference to FIG. 10, the first forming unit 35A switches the state according to attachment and removal of the rear end regulating member 47A, but a configuration in which fixing of the first forming unit 35A (fixing state illustrated in FIG. 10A) is released according to attachment and removal of the rear end regulating member 47A, and the user switches the state of the first forming unit 35A may be adopted. Since the fixing of the first forming unit 35A is released according to attachment and removal of the rear end regulating member 47A, the user does not have to release the fixing of the first forming unit 35A, and an operation time required for attaching the post-processing device 100 can be reduced. Similarly, a configuration in which fixing of the second forming unit 40 is released according to attachment and removal of the rear end regulating member 47A may be adopted.

5. As illustrated in FIG. 6, the discharge unit 30 includes a protection sheet 34 downstream of the pair of discharge rollers 31. The protection sheet 34 can suppress a contact of the user with the pair of discharge rollers 31. A configuration in which the protection sheet 34 is integrally configured with the rear end regulating member 47, and by removing the rear end regulating member 47, the protection sheet 34 is also removed may be adopted.

6. In each embodiment described above, the tray 46 and the rear end regulating member 47 are separately configured, but the tray 46 and the rear end regulating member 47 may be integrally configured.

In addition, the present disclosure is not limited to each embodiment described above, various modifications are possible within the scope of the present disclosure described in the claims, and it goes without saying that such modifications are also included in the scope of the present disclosure.

What is claimed is:

1. A recording apparatus comprising:

a recording unit that performs recording on a medium;

a discharge unit that discharges a medium on which recording is performed by the recording unit; and a medium receiving unit that receives a medium discharged by the discharge unit, wherein a medium is fed to an optional device attached to an apparatus main body from the discharge unit, the discharge unit includes a discharge roller that discharges a medium, a forming unit that forms a medium to be discharged, and a detection unit that detects a stacking height of a medium stacked on the medium receiving unit and is located at a position where the detection unit interferes with the optional device when the optional device is attached, the detection unit and the forming unit are integrally configured, and the detection unit and the forming unit are configured to be integrally attached to and removed from the apparatus main body.

2. The recording apparatus according to claim 1, wherein at least a part of the medium receiving unit is an attaching and removing portion that is configured to be attached to and removed from the apparatus main body, and the detection unit and the forming unit are integrally configured through the attaching and removing portion.

3. The recording apparatus according to claim 2, wherein the attaching and removing portion is located at a position where the attaching and removing portion interferes with the optional device when the optional device is attached.

4. The recording apparatus according to claim 3, wherein the attaching and removing portion abuts on a rear end of a medium stocked on the medium receiving unit and defines a position of the rear end.

5. The recording apparatus according to claim 1, wherein the detection unit includes a light emitter that emits detection light in a width direction intersecting with a discharge direction of a medium, and a light receiver that receives the detection light, and the light emitter and the light receiver are provided at positions where the light emitter and the light receiver mutually face interposing, between the light emitter and the light receiver, a medium stacked on the medium receiving unit in the width direction.

6. The recording apparatus according to claim 1, wherein when the forming unit integrally configured with the detection unit is a first forming unit that comes into contact with a first surface of a medium, the discharge unit includes a second forming unit that comes into contact with a second surface opposite to the first surface of the medium and forms the medium together with the first forming unit, the first forming unit, of the first forming unit and the second forming unit, is integrally configured with the detection unit, and the first forming unit is located downstream in a discharge direction of a medium with respect to the second forming unit.

7. A recording apparatus comprising:

a recording unit that performs recording on a medium;

a discharge unit that discharges a medium on which recording is performed by the recording unit; and a medium receiving unit that receives a medium discharged by the discharge unit, wherein a medium is fed to an optional device attached to an apparatus main body from the discharge unit, the discharge unit includes a discharge roller that discharges a medium, and a forming unit that forms a medium to be discharged, at least a part of the medium receiving unit is an attaching and removing portion that is configured to be attached to and removed from the apparatus main body, the attaching and removing portion is located at a position where the attaching and removing portion interferes with the optional device when the optional device is attached, and the attaching and removing portion and the forming unit are integrally configured and are configured to be integrally attached to and removed from the apparatus main body.

8. A recording apparatus comprising:

a recording unit that performs recording on a medium;

a discharge unit that discharges a medium on which recording is performed by the recording unit; and a medium receiving unit that receives a medium discharged by the discharge unit, wherein a medium is fed to an optional device attached to an apparatus main body from the discharge unit, the discharge unit includes a discharge roller that discharges a medium, a forming unit that forms a medium to be discharged, and a detection unit that detects a stacking height of a medium stacked on the medium receiving unit, is located at a position where the detection unit interferes with the optional device when the optional device is attached, and is configured to be attached to and removed from the apparatus main body, the forming unit is configured to switch between a first state in which the forming unit forms a medium and a second state in which the forming unit is separated from the medium from the first state, the detection unit is provided and engaged with the forming unit, and when the detection unit is removed, the forming unit switches from the first state to the second state.

* * * * *